US010916866B1

(12) United States Patent
Yang

(10) Patent No.: US 10,916,866 B1
(45) Date of Patent: Feb. 9, 2021

(54) COAXIAL CABLE CONNECTOR

(71) Applicant: BNS PRECISION INDUSTRY CO., LTD., New Taipei (TW)

(72) Inventor: Kuo Chang Yang, New Taipei (TW)

(73) Assignee: BNS Precision Industry Co., LTD., New Taipei (TW)

( * ) Notice: Subject to any disclaimer, the term of this patent is extended or adjusted under 35 U.S.C. 154(b) by 0 days.

(21) Appl. No.: 16/709,910

(22) Filed: Dec. 10, 2019

(30) Foreign Application Priority Data

Sep. 26, 2019 (TW) ..... 108212762 U

(51) Int. Cl.
*H01R 9/05* (2006.01)
*H01R 13/52* (2006.01)

(52) U.S. Cl.
CPC ..... *H01R 9/0524* (2013.01); *H01R 13/5202* (2013.01)

(58) Field of Classification Search
CPC . H01R 13/521; H01R 13/5202; H01R 9/0524
See application file for complete search history.

(56) References Cited

U.S. PATENT DOCUMENTS 5,338,225 A * 8/1994 Jacobsen ..... H01R 9/0518 439/585
7,950,957 B1 * 5/2011 Yang ..... H01R 13/5205 439/578
8,167,635 B1 * 5/2012 Mathews ..... H01R 13/5205 439/277
8,579,658 B2 * 11/2013 Youtsey ..... H01R 24/40 439/578
9,048,599 B2 * 6/2015 Burris ..... H01R 9/05
9,136,654 B2 * 9/2015 Matzen ..... H01R 9/05
9,705,211 B2 * 7/2017 Chastain ..... H01R 13/5202

* cited by examiner

*Primary Examiner* — James Harvey
(74) *Attorney, Agent, or Firm* — Skaar Ulbrich Macari, P.A.

(57) ABSTRACT

A coaxial cable connector includes a hexagonal body on an outer portion of nut of a coupling head; an opening spring washer combined with a sleeve of the coupling head; an inner tube shaft threaded through the coupling head and assembled with a joint seat; the inner tube shaft set with a center through-hole and including a tapered bevel disposed in a front portion and a clamping layer which is disposed in an inner hole of a tail portion, and a colored flat tire ring. The joint seat is threaded through the inner tube shaft to an end surface layer of the tail portion, and an isolation net of the coaxial cable is turn back onto an outer cover to the tapered bevel. A contraction ring is combined with a chamfer and a bevel of the sleeve to form a gapless tightness.

4 Claims, 5 Drawing Sheets

COAXIAL CABLE CONNECTOR

PRIORITY

This application claims priority to Taiwan Patent Application No. 108212762 filed on Sep. 26, 2019, which is hereby incorporated by reference in its entirety.

FIELD

The present invention provides a coaxial cable connector, which is waterproof, moisture-proof and uneasy to loosen by using components of the connector each made of metal, squeezing the contraction tube ring and sleeve structure, and then locking the open spring washer and the mother seat.

BACKGROUND

The cable television systems, common antenna and direct broadcast satellite (DBS) TV used nowadays are connected to the signal distributor through the main line of the system or the low noise satellite frequency down converter, and then the signal distributor is connected to a client to receive the signals of the television systems. The coaxial cable for the transmission have a coaxial cable connector at the front and rear end thereof, and then the coaxial cable connector is connected to the distributor and the display screen of the user.

Conventional coaxial cable connector is please referred to FIG. 1, the F type coaxial cable connector including a connector body, which includes a clip tube, a central axis which is configured in the clip tube, and a thread which is configured in around a central axis, and the peeling part of the coaxial cable is threaded into the inlet end of the connector body to make the insulator A2 and the center conductor A1 inside the cylindrical part, and the isolation net A3 and outer cover A4 are arranged between the external of the center axis and the clip tube; then, a pressure is applied to the clip tube by a hexagonal clipping tool to force it to seal with the outer cover A4 of the coaxial cable A.

When this kind of the connector joints with the coaxial cable, the hexagonal clipping tool should be used to make the clip tube pressed by the pressure to a hexagonal surface which closely fits the coaxial cable. However, due to the uneven bearing surface, there are still gaps between the hexagonal clipping surface and the coaxial cable, thereby causing rain and moisture infiltration and leading to oxidation or aging damage of the coaxial cable connector, which might affect the signal transmission. For this reason, the manufacturers in the business are urgent to research and improve in this direction.

SUMMARY

Provided is a coaxial cable connector, which can prevent rain and moisture infiltration, and is uneasy to loosen after locking and easily assembled.

The disclosure includes a coaxial cable connector comprising a coupling head with an outer portion of nut having a hexagonal body, a joint seat and a sleeve that is combined with the coupling head, and an inner tube shaft that is threaded through the coupling head and the sleeve, tightly assembled.

Wherein the inner tube shaft is set with a center through-hole, a tapered bevel which is disposed in a front portion and a clamping layer which is disposed in an inner hole of a tail portion, and a colored flat tire ring is provided. A groove and a barrier layer is disposed at the thread of inner hole of the coupling head. The front end of the sleeve is in a ladder-like shape, an embedded groove is disposed in a contraction ring and another end surface layer at the end of the joint seat. A joint seat is threaded through an inner tube shaft to a clamping layer of the tail portion while installing a coaxial cable, and an isolation net of the coaxial cable is turn back onto an outer cover to the tapered bevel, so as to make the isolation net ground. A joint seat is squeezed to a sleeve to be sealed, wherein a contraction ring is disposed in the sleeve therebetween. When joint seat slides and squeezes contraction ring to cooperate with a bevel and a chamfer of the sleeve, it forms no gap. Thus, the coaxial cable and the connector can be added functions of waterproof and moisture-proof, and uneasy to loosen, while being easily assembled.

The detailed technology and preferred embodiments implemented for the subject invention are described in the following paragraphs accompanying the appended drawings for people skilled in this field to well appreciate the features of the claimed invention.

DETAILED DESCRIPTION

In the following descriptions, the present invention will be explained with reference to various example embodiments; nevertheless, these embodiments are not intended to limit the present invention to any specific example, environment, application, or particular implementation described herein. Therefore, descriptions of these example embodiments are only provided for purpose of illustration rather than to limit the present invention. The various features or aspects discussed herein can also be combined in additional combinations and embodiments, whether or not explicitly discussed herein, without departing from the scope of the invention.

Figure 1:
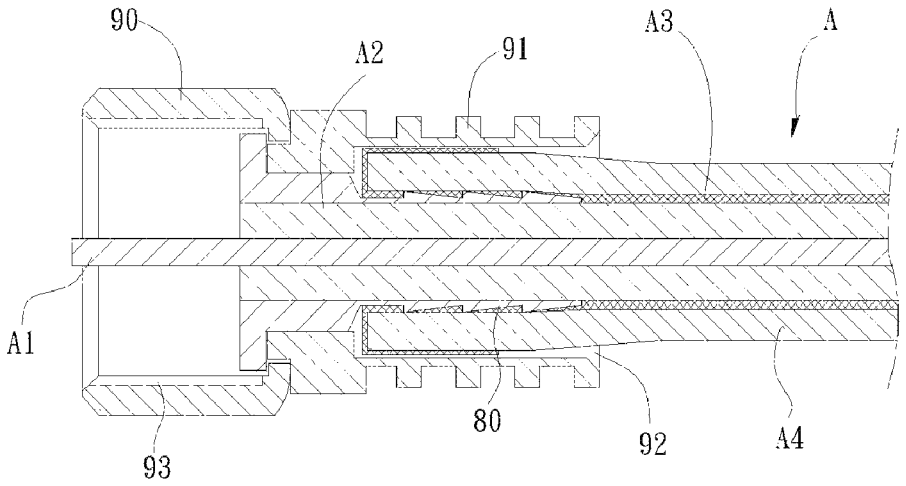
FIG. 1 (prior art)
FIG. 1 is a section view of the conventional coaxial cable connector.
Figure 2:
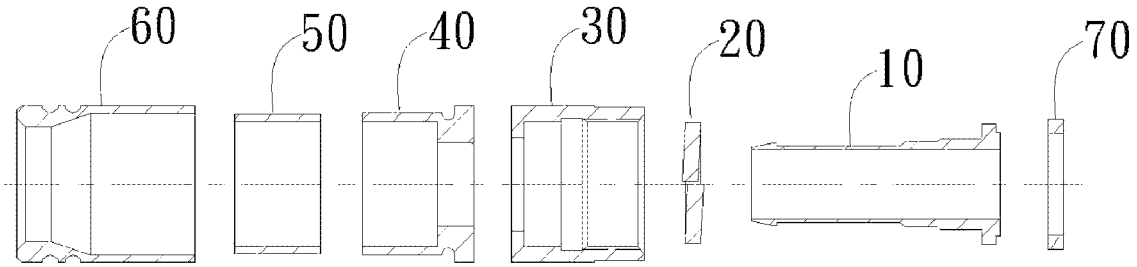
FIG. 2 is an exploded view of a coaxial cable connector according to the present invention.

Please refer to FIG. 2, the coaxial cable connector of the present invention comprises an inner tube shaft 10, an opening spring washer 20 and a coupling head 30 which are combined with one another first. Next, a joint seat 40 was fitted into a contraction ring 50 into an embedded groove 401 and an end surface layer 402. Then, a colored flat tire ring 70 is fitted into the coupling head 30. Finally, the joint seat 40 is pressed into a sleeve 60 to complete the assembly.

Figure 3:
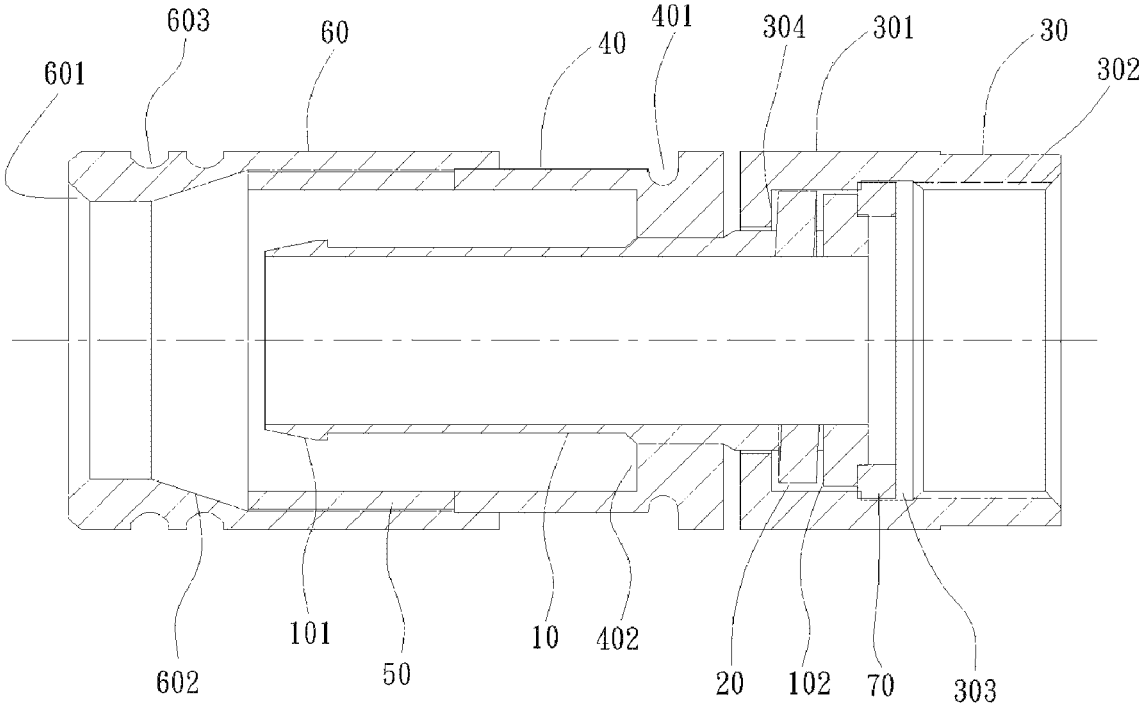
FIG. 3 is a section view of a coaxial cable connector in assembling according to the present invention.

Please refer to FIG. 3, the coupling head of the present invention is illustrated by an F-type coupling head 30, which is tightly fitted by the inner tube shaft 10 threaded through the coupling head 30 and the joint seat 40. The inner tube shaft 10 is provided with a center through-through hole, a tapered bevel 101 and a clamping layer 102 are disposed on the front portion, and a hexagonal body 301 is disposed on the outer layer end of the F-type coupling head 30. A groove 303 is disposed in the inner hole of the hexagonal body 301, a thread 302 and the opening spring washer 20 are disposed in the inner hole, and a barrier layer 304 is disposed in the coupling head 30.

An embedded groove 401 and an end surface layer 402 are disposed in the joint seat 40. A chamfer 601 is disposed on the inside of the front end of the sleeve 60. A bevel 602 and a semicircle corner 603 are disposed on the outside, and combined with the contraction ring 50.

The inner tube shaft 10 is provided with a center through-hole, a tapered bevel 101 which is disposed on the front portion, and a clamping layer 102 which is disposed in the inner hole of the tail portion, and the colored flat tire ring 70 is disposed on the outer ring. The outer layer end of the coupling head 30 is provided with a hexagonal body 301, a thread 302 and a groove 303.

Figure 4:
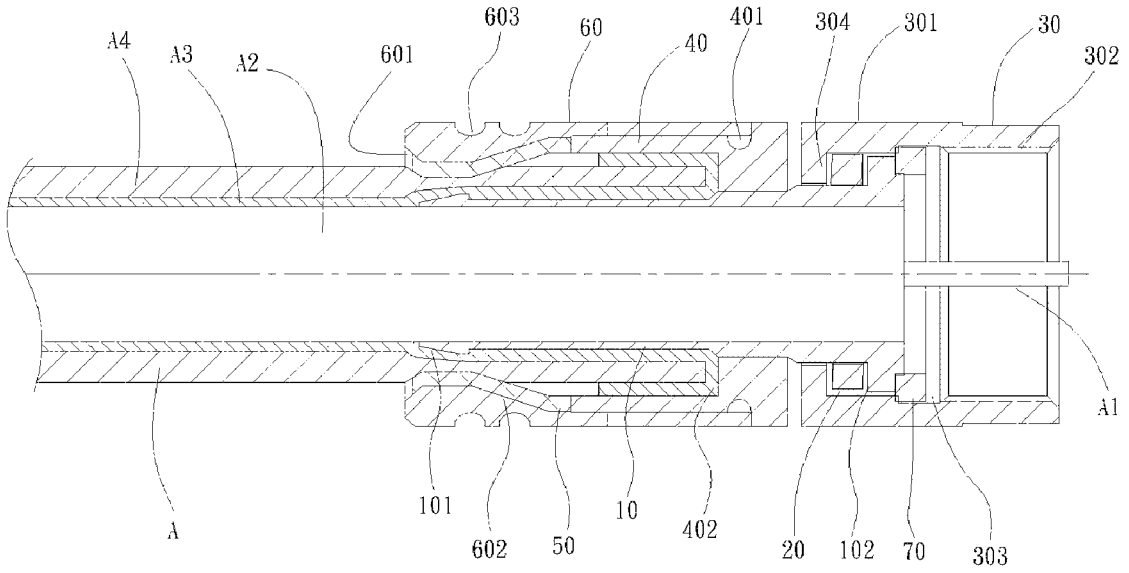
FIG. 4 is a schematic view of a coaxial cable connector after assembling according to the present invention.

Please refer to FIG. 4, when assembling, the inner tube shaft 10, the opening spring washer 20 and the coupling head 30 are provided, the inner tube shaft 10 is inserted vertically into the end surface of the thread 302 of the coupling head 30. By combined with the sleeve 60 and using the barrier layer 304 and the clamping layer 102, the coupling head 30 can be rotated freely. Then, the colored flat tire ring 70 is tightly fitted with the hexagonal body 301, the thread 302 and the groove 303. Besides, after the contraction ring 50 is disposed into the sleeve 60, the inner tube shaft 10, the open spring washer 20 and the coupling head 30 are combined with one another, the colored flat tire ring 70 is disposed into the groove 303, and then the joint seat 40 is pressed into the sleeve 60 to make it slidable and assembled.

Figure 5:
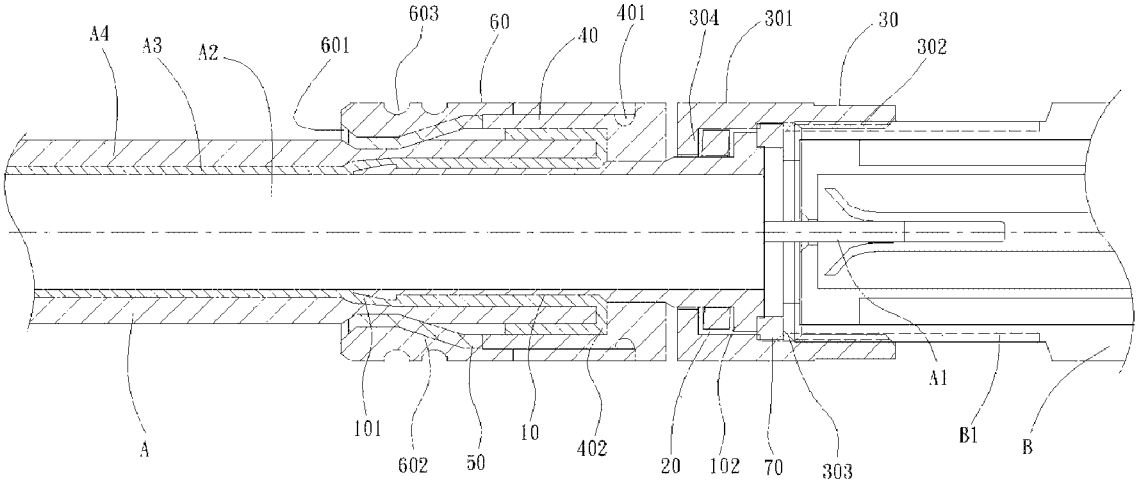
FIG. 5 is schematic view of usage of a coaxial cable connector according to the present invention.

Please refer to FIG. 5, when using, the peeled end of the coaxial cable A is threaded into sleeve 60 and the chamfer 601, so that the central conductor A1 of the coaxial cable A, the insulator A2 and the isolation net A3 are in the inner tube shaft 10. The outer cover A4 is disposed on the outside of the joint seat 40, with using the tool to compress the joint seat 40, the contraction ring 50 contract inward toward a sleeve 60. The outer cover A4 of the coaxial cable makes the joint seat 40 and the colored flat tire ring 70 put into the groove 303 of the coupling head 30 after the contraction ring 50 is put into the sleeve 60. Then, the joint seat 40 is pressed into the sleeve 60 to affix the coaxial cable and form a gapless tightness to prevent rain and moisture infiltration. In the next, after the opening spring washer 20 is added to connect with a mother seat B and locked with a thread B1, the coaxial cable will not be shaken by the strong wind blowing outdoors, which will cause the connector to loosen from the mother seat B, affect the signal transmission and cause noise.

According to the above descriptions, the improved structure of coaxial cable connector according to the present invention has the following advantages:

1. It is easy to squeeze with the sleeve structure after adding the contraction ring, and it can be tightly fitted with the cable to prevent rain and moisture infiltration, and the structure is uneasy to loosen after locked and easy to be assembled.

2. By adding the opening spring washer, and connecting and locking it with the mother seat, it will not be shaken by the strong wind blowing outdoors, which will cause the connector to loosen from the mother seat, affect the signal transmission and easily produce noise interference.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A coaxial cable connector, comprising:

a coupling head, comprising a hexagonal body on an outer portion of nut thereof;

an opening spring washer;

a sleeve, combined with the coupling head, and an inner tube shaft, threaded through the coupling head and tightly assembled with a joint seat;

wherein the inner tube shaft is set with a center through-hole, a tapered bevel which is disposed in a front portion and a clamping layer which is disposed in an inner hole of a tail portion, and a colored flat tire ring is provided to fit in a groove;

wherein the joint seat is threaded through the inner tube shaft to an end surface layer of the tail portion while installing a coaxial cable, and an isolation net of the coaxial cable is turn back onto an outer cover to the tapered bevel, so as to make the isolation net grounded, and meanwhile the joint seat is squeezed to a sleeve structure to be sealed; and wherein a contraction ring is disposed in the sleeve and squeezed with the joint seat, the contraction ring is combined with a chamfer and a bevel of the sleeve to form a gapless tightness.

2. The coaxial cable connector according to claim 1, wherein the outside of nut of the coupling head comprises a hexagonal body, a thread, a groove and a barrier layer.

3. The coaxial cable connector according to claim 1, wherein an embedded groove and an end surface layer are disposed inside the joint seat.

4. The coaxial cable connector according to claim 1, wherein a chamfer, bevel and semicircle corner are disposed inside the sleeve.

* * * * *